United States Patent [19]

Cortina

[11] 3,974,618

[45] Aug. 17, 1976

[54] METHOD OF AND MEANS FOR MULTI-STORY BUILDING CONSTRUCTION

[76] Inventor: Pablo Ortega Cortina, Taine 229-Despachos 601-602, Mexico City 5, Mexico

[22] Filed: Aug. 4, 1975

[21] Appl. No.: 601,789

Related U.S. Application Data

[62] Division of Ser. No. 489,030, July 16, 1974.

[30] Foreign Application Priority Data

Mar. 18, 1974 Mexico ..... 149914

[52] U.S. Cl. ..... 52/745; 52/126; 52/236; 214/1 H

[51] Int. Cl.[2] ..... E04G 21/14

[58] Field of Search ..... 52/749, 747, 745, 126, 52/236; 214/1 H, 15; 254/105

[56] References Cited

UNITED STATES PATENTS

| | | | |
|---|---|---|---|
| 1,362,069 | 12/1920 | Witzel | 52/745 |
| 2,720,017 | 10/1955 | Youtz | 52/745 |
| 2,964,143 | 12/1960 | Fayeton | 52/745 |
| 3,036,816 | 5/1962 | Stubbs et al. | 52/126 |
| 3,053,015 | 9/1962 | Graham | 52/126 |
| 3,494,092 | 2/1970 | Johnson et al. | 52/745 |
| 3,789,455 | 2/1974 | Miram | 52/745 |

OTHER PUBLICATIONS

"Forecasting: A New Era for Concrete" by Fred N. Severud Dec. 1949 Architectural Record, pp. 134–138.

*Primary Examiner*—J. Karl Bell
*Attorney, Agent, or Firm*—Jones, Tullar & Cooper

[57] ABSTRACT

There is shown the preforming of walls and floor slabs as a stack wherein the walls of each story are connected to the next floor slab thereabove by lift pickup cables spaced along the to be top edge of each wall. Lift apparatus forming no part of the building is provided for attaching lift fixtures to elements cast in the edges of the floor slabs. The lift apparatus includes pairs of columns as necessary supporting a repositionable upward bridge therebetween having lifting jacks operating lift rods connected with the floor slabs below by the removable lift fixtures. The whole stack is lifted and starting with the first floor the ceiling slab lifts the walls therebelow which swing out and are guided into position under the slab thereabove and become load bearing walls. Successive like lifts are made to position the respective ceiling slabs and load bearing walls. Suitable vertically aligned apertures are formed in the walls and slabs above for installation of reinforcing rods.

5 Claims, 18 Drawing Figures

29
32
31
33
24
23
22
10
11c
11b
11a
28b
30
27
28a
28

29
32
31
33
24
23
22
10
11c
11b
11a
28b
30
27
39
28a
28

29
32
31
33
24
23
22
10
49
11c
11b
11a
28b
30
27
39
28a
28

FIG. 14a
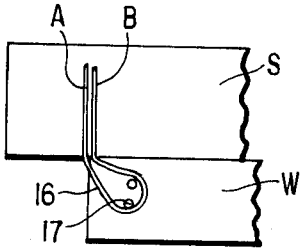
FIG. 14b
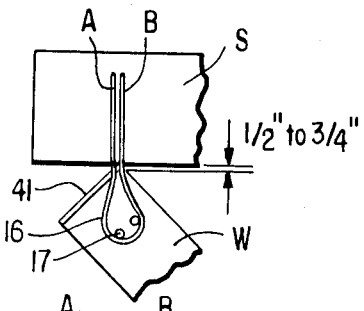
FIG. 14c
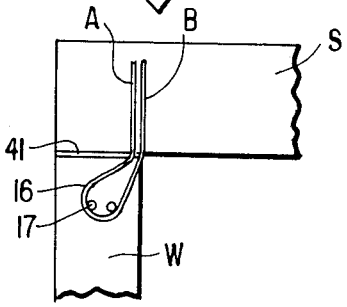
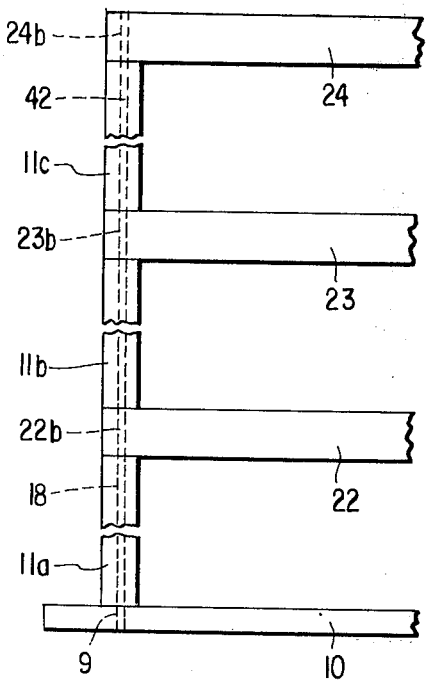
FIG. 15
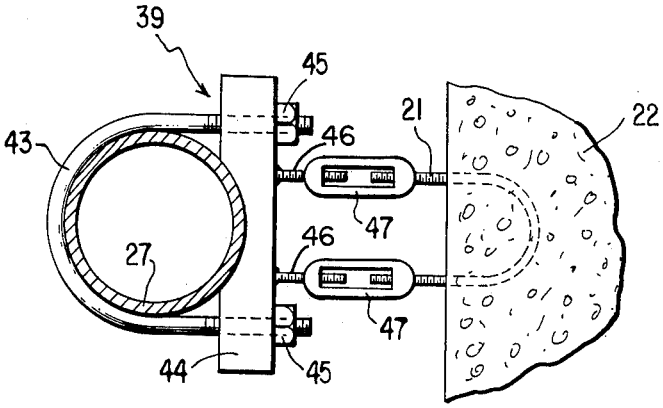
FIG. 16

METHOD OF AND MEANS FOR MULTI-STORY BUILDING CONSTRUCTION

This is a division, of application Ser. No. 489,030, filed July 16, 1974.

BACKGROUND OF THE INVENTION

1. Field of the Invention

An on site erected structure consisting of sets of horizontally cast walls connected by lift pickup cables to a ceiling slab cast thereabove and externally erected lift means. The stack of cast sets are lifted as a whole and the lowest most ceiling slab lifts the walls attached therebelow that each swing simultaneously outward and are plumbed into position as load bearing walls followed by successive lifts to position the ceiling or floor slabs and their walls after which reinforcing rods are grouted in aligned vertical apertures cast in the walls and slabs.

2. Prior Art

Buildings have been erected by forming floor slabs one upon the other at ground level with spaced apart vertical columns extending up through the floors and lifting apparatus applied to the columns that are partially formed as the slabs are raised into position and completion of the pouring of the columns takes place as the lifting of the floors progresses such as shown in U.S. patent 1,066,436. In U.S. Pat. No. 2,720,017 the columns are set completely in place and the lifting gear placed on their tops to lift floor slabs cast one above the other with lift collars about the columns cast with each floor.

There have also been precast walls and floors in the same plane and connected together by hinge members. The units are lifted by a crane into position with the walls hinging on their hinge members downward and inward such as in U.S. Pat. Nos. 3,494,092 and 3,727,157. Danish Pat. No. 82,772 of 1957 shows forming walls or column elements in horizontal position under a slab on a scaffold and letting the walls or column elements hinge down into position or forming the walls or column elements on the ground or a floor and casting a floor slab thereabove and connecting them by a thin steel band that acts as a hinge. There is no lifting gear disclosed. The disclosure seems to be to individual houses and separate stories of buildings. A translation of the patent appears to say that the invention is to avoid referred to larger or smaller lifting-gear and cranes together with the work associated with them.

SUMMARY OF THE INVENTION

An object of the invention is to provide a building by self-erecting walls precast in a horizontal position on a floor, or casting bed casting a ceiling slab thereabove to which the walls are hangingly connected by pick-up cables and lifting the slab while swinging the walls outwardly with their bottom ends sliding along the floor below thereby adding to stabilization of the self-erection.

Another object of the invention is to provide for erecting successively cast sets of load bearing walls connected to ceiling slabs cast thereabove into a multistory building and adding to the stability of the erected building by installing vertical reinforcing rods in cast in aligned apertures in the walls and ceiling slabs.

A further object of the invention is to provide overload protection for each lifting fixture by lifting in sequence each successive lower slab of a stack of sets of slabs and connected walls allowing separation of slab and its walls to occur at the initial part of a lift of the stack.

Yet another object of the invention is to provide lift fixtures to be detachably attached to the slabs of a stack of sets of slabs and walls and to each other fixture that can be removed in sequence from the bottom slab after it has been lifted and lowered onto its connected supporting walls.

Still another object of the invention is to provide lifting apparatus for sets of slabs and connected walls in a stack that has pairs of externally positioned columns supporting a bridge member and lift jacks thereon that is repositionable upward for making successive lifts after connecting and disconnecting lift rods from the jacks to lift fixtures provided for the respective successive stacked slabs.

Another object of the invention is to provide stabilization in lifting a stack of sets of ceiling slabs and connected support walls by installing temporary pairs of erecting columns installing a bridge member between the pairs of columns and temporarily securing it in a stabilizing manner in successive lift positions and applying a stabilizer between a lifted ceiling or floor slab and the adjacent column.

A further object of the invention is to provide a connection between a horizontally precast wall on a floor and a ceiling slab cast thereabove consisting of a piece of cable that is formed with a loop at its lower end cast in the wall's top edge with the loop lying in a plane extending transverse to the top edge of the wall and extending the ends of the cable upward for casting into the ceiling slab adjacent its edge in such a position that the top edge of the wall aligns to support the edge of the slab above and there is a spacing of approximately a half to three quarters of an inch between the slab and the hanging wall as the slab is lifted. The support by the cable is from the leg end thereof that is positioned nearer the edge of the slab and extends down to its loop portion therebelow during the first part of the swing of the wall outwardly to about a 45 degree inclination then the support of the wall shifts to the other leg of the cable and to its portion of the loop directly therebelow whereby breaking and spauling of the concrete is avoided.

DESCRIPTION OF THE DRAWING

For a more complete understanding of the nature and scope of the invention reference is had to the drawings, the description and the claims that follow.

FIG. 1 is a perspective view of a typical ground floor slab having cast thereon the necessary to be lifted and swung into position supporting walls with their ceiling slab thereabove to which they are attached along their to be top edges by pick-up cables cast therein illustrative for a three story building, the topmost ceiling slab being fragmentally shown;

FIG. 14*a* is a fragmentary showing of a floor slab and its attached wall and the lift pick-up cable at start of lift;

FIG. 14*b* shows the wall swung outward about 45°, installation of sealing material and the relatively small spacing between wall and supporting slab and the shift in cable portion support;

FIG. 14*c* shows the wall having been laterally aligned and in load bearing position under the edge of the slab;

FIG. 15 is a showing of the erected walls and slabs and the aligned apertures formed in the walls and slabs with seismic reinforcement grouted in place; and FIG. 16 is a showing of a form that the stabilizer between slab and erecting column may take;

DESCRIPTION OF A PREFERRED EMBODIMENT

Figure 4:
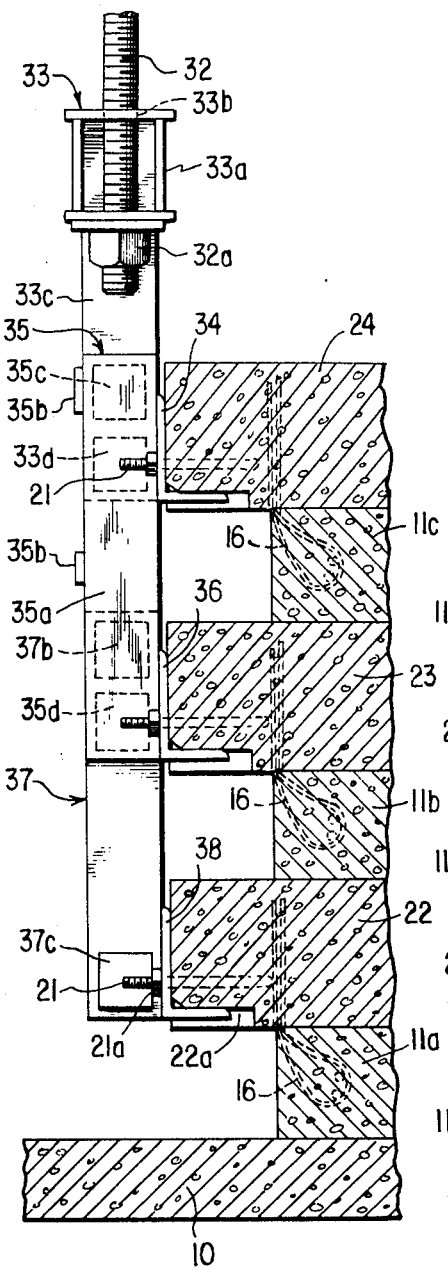
FIG. 4 is a cross sectional fragmentary side view of the ground floor slab, the horizontally cast supporting walls connected by cast in pick-up cables to their ceiling slabs thereabove and a side view of the lift attaching members cast in the slabs with the lift fixtures attached.
Figure 8:
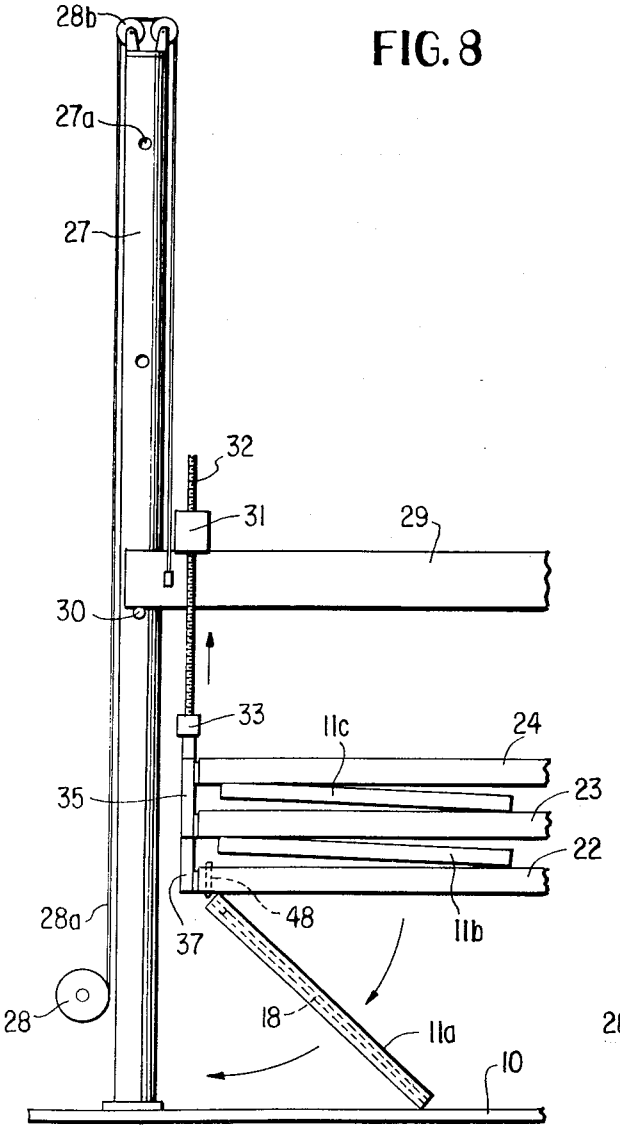
FIG. 8 is a view similar to FIG. 7 showing the first floor support walls swinging slowly outwardly towards their vertical supporting position as the lift progresses and an aperture in the wall and in its ceiling slab above is typically shown ready to receive a stabilizing pin which will be replaced by permanent reinforcing rods.

In FIG. 1 a typical ground floor slab 10 has been provided on suitable foundations and in the illustration it extends outward to provide foundation supports for vertical support columns to be described. A ground floor slab could extend only to the perimeter of the walls of the building and separate foundations would then be provided for each vertical support column. On the ground floor or casting bed 10 are successively cast load bearing walls and their ceiling slabs. A separating layer of bond-preventing material (not shown) is placed on the top of the ground floor slab 10. Suitable forms (not shown) are provided on the ground floor slab for first story walls 11a, 12a, 13a and 14a to be poured similar to the third story walls 11c, 12c, 13c and 14c showing in FIG. 1. As many full or partial length perimeter load-bearing structural walls are precast as geometry will allow. There is placed within the forms unglazed windows 15, whose frames are of a wall thickness. Also placed in the forms are reinforcing steel, electric rough-in and possible plumbing (all not shown). Lift pick-up cables 16 are cast in the walls and project along their to be top edge at spaced apart positions. They are formed with a loop at their lower end that passes around securing and reinforcing bars 17, see FIGS. 4 and 5, and the two ends extend out to be cast in the ceiling slab thereabove to be described. Greased rods (not shown) are placed in the walls in their to be vertical direction and removed two to three hours after the concrete is cast. These provide apertures such as typically shown at 18 in FIG. 8 and as illustrated in FIG. 15 to receive reinforcing rods that are later installed between walls and floors and grouted in. FIG. 8 shows a temporary holding pin 48 inserted through a hole in the ceiling slab that is in alignment with the aperture 18. After overnight curing the wall forms are removed and used again. Any voids between the walls such as at 19, see FIG. 1, are filled with like interior load-bearing pick-up walls or waste material such as soil and perhaps finished with a thin waste-slab of concrete.

Figure 2:
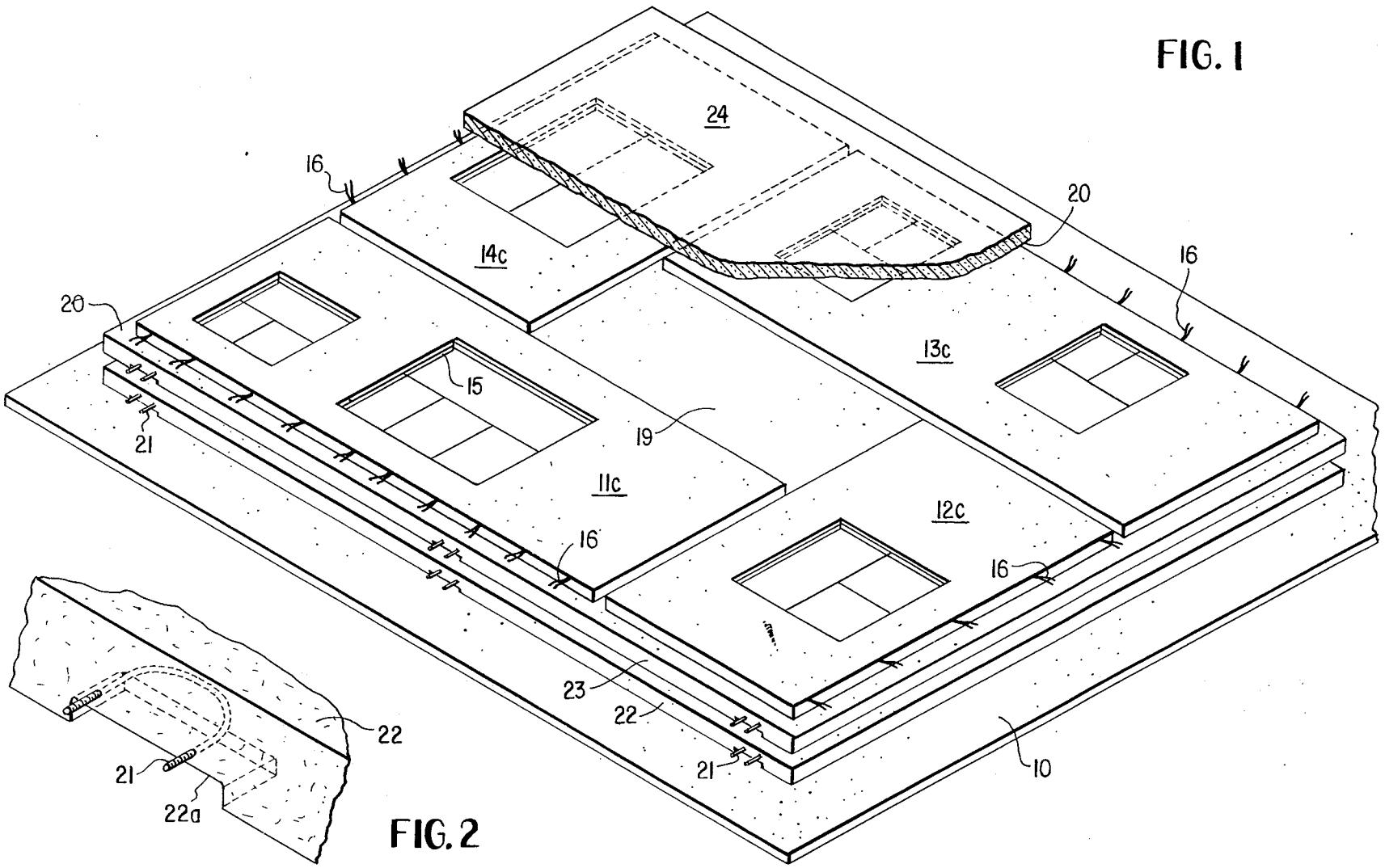
FIG. 2 is a fragmentary perspective view of the edge of a floor and/or ceiling slab with a lift attaching member cast therein and a recess therebelow in the lower face at the slab edge both for receiving and attaching a lift fixture.

A separating layer of bond-preventing material (not shown) is placed over the cured first story walls. The ceiling slab for the first story is next to be cast over the first story now cured walls. A slab perimeter form (not shown) overhanging the wall edges is installed. The perimeter overhang, see at 20 in FIG. 1, is at least the width of the load bearing wall cast below whose to be top edge will support the ceiling slab underneath this overhanging portion. The projecting ends of the pick-up cables 16 are placed in position within the forms for the ceiling slab. Also lift attaching members 21 such as U-bolts, see FIG. 2, are placed in the form and their threaded ends project out from the edge of the ceiling slab 22 for the first story, see FIGS. 1 and 2. Just below the lift attaching member 21 the form is provided with a filler block (not shown) so as to form a recess 22*a* extending in from the edge of the slab at its bottom face. The lift attaching member 21 and the recess 22*a*, see FIGS. 4 and 5, receive a web of an angle bar on a lift fixture to be described. Instead of the U-shaped bolt 21, two L-shaped members could be cast in the slab with the legs threaded and projecting spaced apart at the edge of the slab to receive the lift fixtures.

Figure 3:
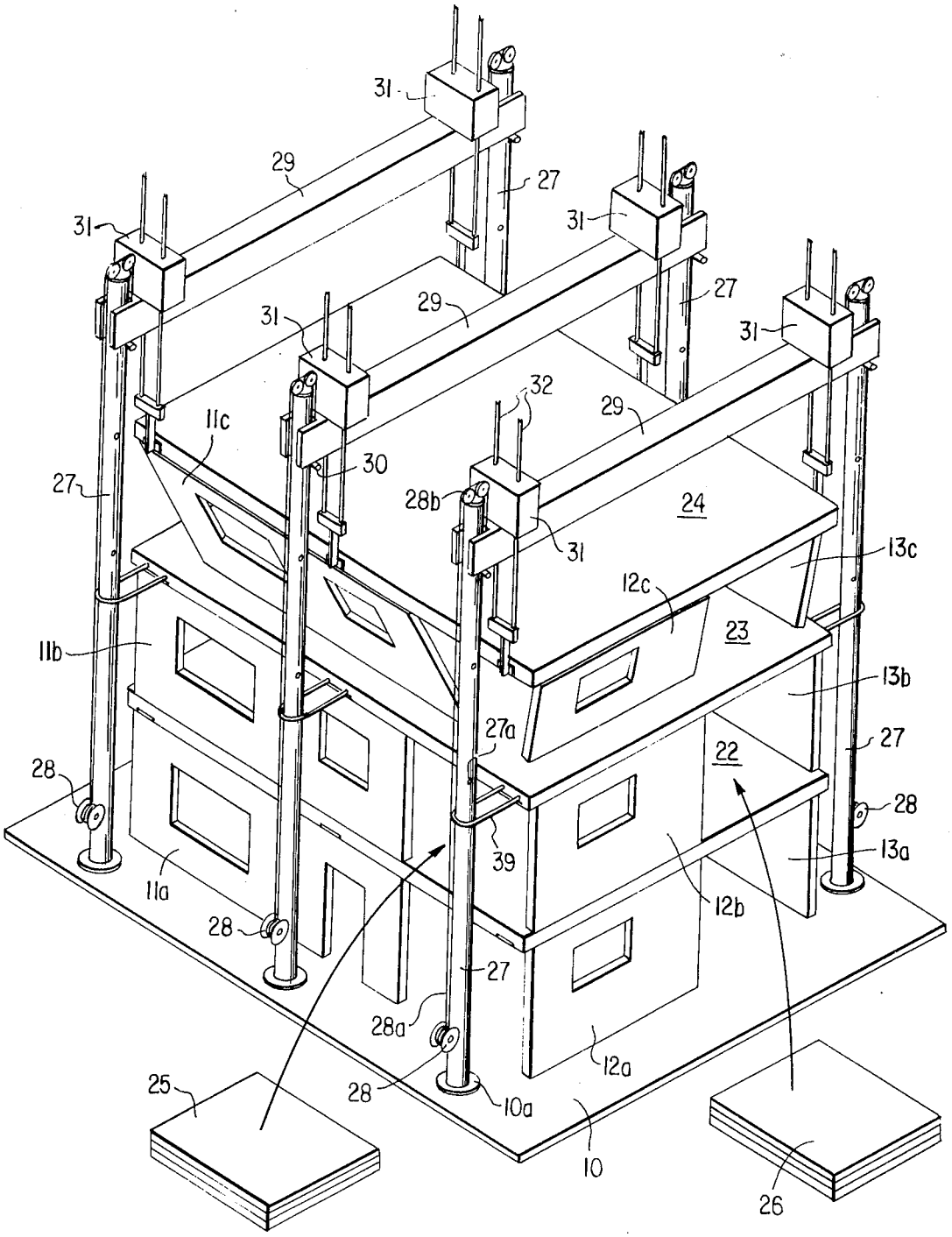
FIG. 3 is a perspective view of the three story building with lifting apparatus in position, the supporting walls for the third story being swung into position as their ceiling slab to which they are attached by pick-up cables is lifted into position and precast wall panels ready for lift by a crane to fill the void wall spaces.

Referring to FIGS. 1 and 3 and the other applicable figures the next two stories above have their sets of supporting walls and ceiling slabs likewise cast and connected. The walls are respectively numbered 11*a*, 12*a*, 13*a* and 14*a* for the first story. The second story walls are numbered 11*b*, 12*b*, 13*b* and 14*b* and as noted above the third story walls are respectively 11*c*, 12*c*, 13*c* and 14*c*. The first story ceiling slab as indicated above is 22, the second story ceiling slab is 23 and the third story ceiling slab or roof slab is 24. Ceiling slab 22 is the floor slab for the second story and ceiling slab 23 is the floor slab for the third floor.

After the erection as will hereinafter be described the void wall spaces are filled by separately cast wall slabs indicated in the piles 25 and 26. These are lifted and set in place by a separate crane.

The matter of erecting the building and lifting into position the designated ceiling slabs and their load bearing walls will be described. On the ground floor slab there is provided foundation supports 10a for the vertical support columns 27. These columns are about three feet longer than the total height of the building. For the particular three story building to be erected three pairs of temporary support columns 27 are placed on their support foundations 10*a* and secured by hold down bolts and grouting (not shown). Each column has a one ton hand operated winch 28 installed near its lower end. This is for hoisting the cross bridges 29 into their successive lift positions above the pile of cast slabs and their load bearing connected walls to be swung outwardly into position during the lifting operation. Each winch has a cable 28*a* that is led up the column and over sheaves 28*b* mounted at the top of the column and then down to where it is secured to the cross bridge 29. The number of pairs of support columns 27 and the center-to-center spacing between the three pairs is a function of the separate jack or separate lift means capacity and convenience. Each bridge 29 is bifurcated at its ends to receive the columns 27 and be guided thereby in their sliding engagement with the columns. Means are provided at fixed points along the columns for supporting the cross bridge for one lift per each ceiling slab or floors. A connection shown is provided by having through apertures through which is inserted a support pin 30. a welded-in tube (not shown) to reinforce the through apertures 27*a* could be provided, appropriate saddles (not shown) are used to provide fixity and to distribute the load on the support pins 30.

Near the ends of the support bridge 29 adjacent the columns are placed jack lift means 31 such as lift-slab jacks such as shown in U.S. Pat. Nos. 2,758,467 and 3,201,088. Each separate lift means is vertically above the projecting lift attaching members 21 projecting from the slabs below. To attach the lift rods 32 depending from the jacks, lift fixtures which are detachably attached to the slabs and detachably attached to each other are provided.

A top lift fixture is generally indicated as 33. It has a cross head 33*a* of four welded together plates to form a box like member, square in cross section. The cross head 33*a* has vertically extending apertures 33*b* through each end to receive the two depending lift rods 32 that are secured by a nut 32*a* or a quick release hinged type nut used on lift rods in lift-slab work. A depending tension bar 33*c* is welded to the cross head 33*a* and it has a pair of lugs or bosses 33*d* welded to its opposite inner faces adjacent its lower end. An angle bar 34 has its vertically extending web welded to the tension bar 33*c* adjacent the lugs 33*d* thereon and its vertically extending web has apertures therethrough spaced to each side of the tension bar 33*c* to receive the threaded legs of the U-bolt lift attaching member 21 to which it is secured by nuts 21*a*. The transversely extending web or flange of the angle bar 34 projects into the formed recess 24*a* in the top most ceiling slab for lift engagement to avoid interference at erection with wall 11*c*.

Figure 5:
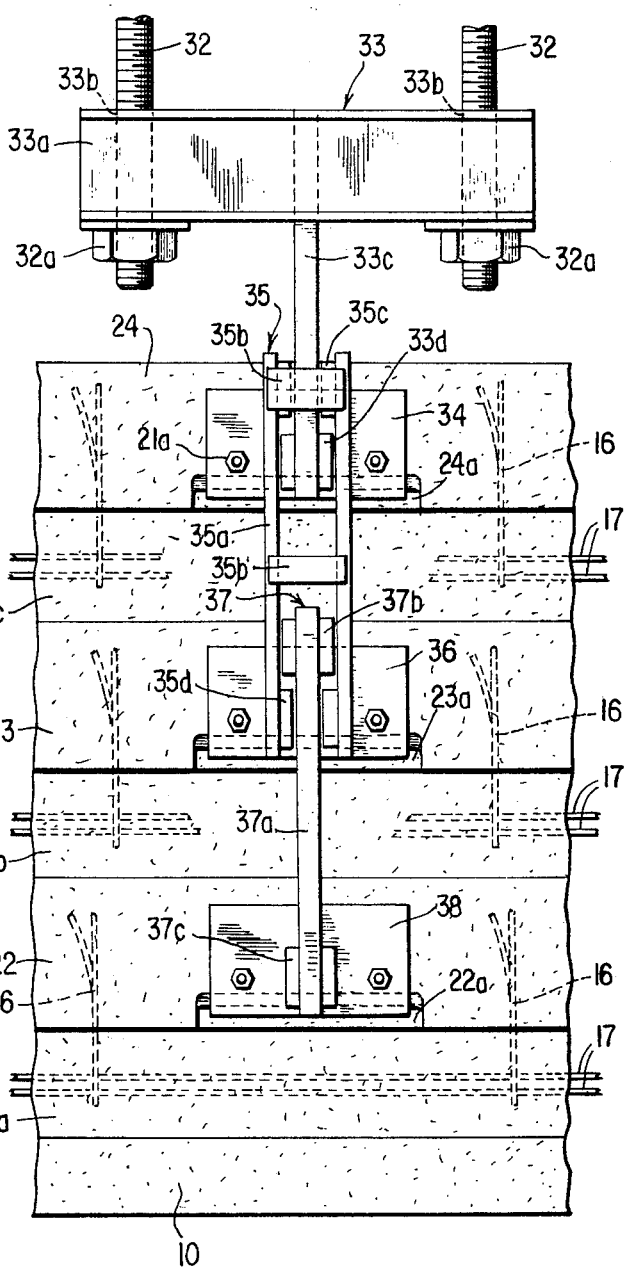
FIG. 5 is a left hand end view of FIG. 4 showing the attached lift fixtures and their connection with each other for successive pick-up from top fixture on down.

A second lift fixture is generally indicated as 35. It is made up of a pair of spaced apart tension bars 35*a* held spaced apart by a pair of spaced apart reinforcing cross pieces 35*b* welded thereto. A pair of lugs 35*c* is welded to the inside faces adjacent the top end of the spaced apart bars while another pair of lugs is welded to the inside faces adjacent the bottom end. Likewise an angle bar 36 is welded to the tension bar 35*a* adjacent its lower end and adjacent the lower pair of lugs 35*d*. The upper web of the angle bar is attached to the projecting threaded legs of the lift attaching member in ceiling slab 23 and its lower web is received in the recess 23*a* of the ceiling slab 23 for lift engagement. Referring to FIG. 5 it will be noted that the top pair of lugs 35*c* on second lift fixture 35 are spaced above the pair of lugs 33*d* on the top lift fixture 33 so that the roof slab 24 is first lifted and its attached walls peeled-out. This spacing is of the order of one-half to about three-fourths inches.

A third lift fixture is generally indicated as 37. It is made up of a tension bar 37*a* that has a pair of lugs or bosses 37*b* welded to its opposite faces adjacent its top end. The tension bar 37*a* is slidably received between the spaced tension bars 35*a* on the lift fixture 35 thereabove and the pair of lugs 37*b* are spaced above the lugs 35*d* on lift fixture 35 for like engagement as explained above for the top lift fixture 33 and the second lift fixture 35. At the lower end of the tension bar 37*a* and on its opposite faces is welded a pair of lugs 37*c* which are for engagement with a type of lift fixture 35 that would be attached to a slab therebelow if a building with greater number of stories was being built. Likewise another lift fixture like the second lift fixture 35 would be required for the next below successive slab of such a larger building. An angle bar 38 has its vertical web welded to the tension bar at the bars lower end and has apertures therethrough like the other lift fixtures to receive the extending threaded ends of the lift attaching member in slab 22. The transverse web of the angle bar 38 is received in the adjacent recess 22*a* for lift engagement with slab 22.

Reference to FIG. 14*a* shows the slab and the wall W in their cast position with the lift pick up cable 16 looped around reinforcing bars 17. The reinforcing bars 17 help position the cable but they are not necessary for anchorage. The unique installation and cable path geometry avoids breaks and spauling of the concrete. At the start of the lift, see FIG. 14*a*, cable portion A pulls in such a direct line that there is no concrete spauling. After the wall W is swung outwardly by lifting of the slab S so that the wall angle passes approximately 45° inclination, see FIG. 14*b*, cable portion B takes over and finishes the job with vertical pulling. Reference to FIG. 14*b* shows that a sealing sheet or sealing material 41 may be installed at the top edge of the wall to provide a seal in its load bearing contact with the slab portion thereabove. The sealing material may be a strip of polyurethane foam, a smear of asphalt or any suitable sealing material. As the wall swings into position a certain amount of lateral alignment is required. The lift pick-up cable does not act as a hinge.

In FIG. 15 there is shown the seismic reinforcement between walls and slabs. The ground floor slab 10 has formed therein vertically extending apertures 9 along its perimeter where it receives the bottom of the load bearing wall. The wall has an aperture 18, see FIG. 8, formed therein during casting and vertically aligned apertures 22*b*, 23*b* and 24*b* are formed in the respective slabs 22, 23 and 24. Reinforcing seismic rods 42 are installed and grouted in position in the aligned apertures.

Figure 9:
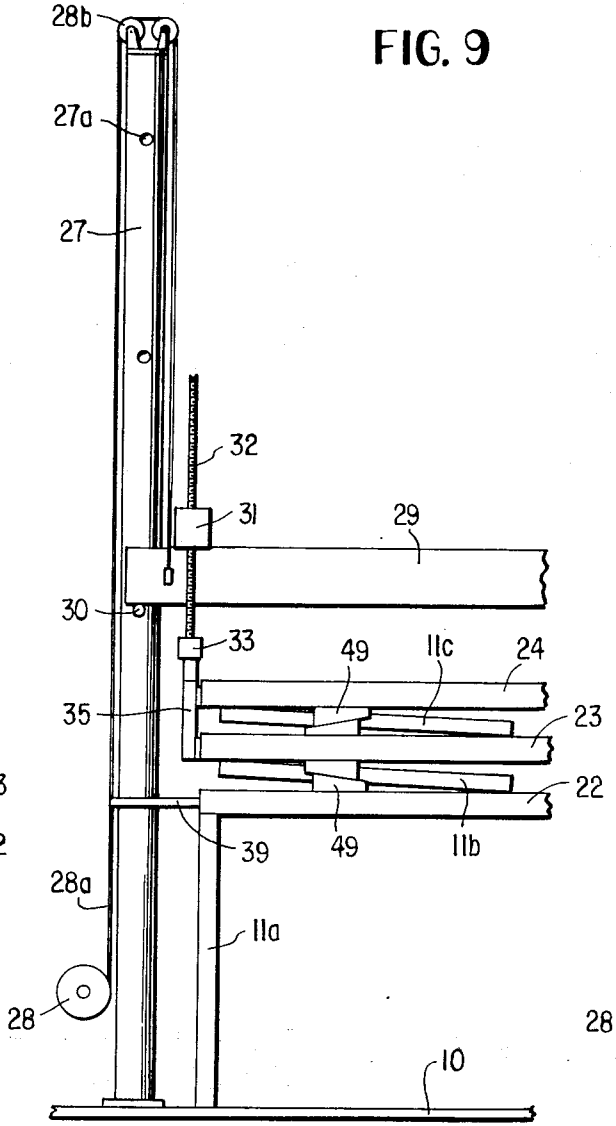
FIG. 9 is similar to FIG. 8 showing the first floor supporting walls supporting their ceiling slab which has its lift fixture removed and stabilizer installed between the ceiling slab and the column and separating wedges in position between the respective ceiling slabs.

Referring to FIG. 16 there is illustrated a form that a stabilizer 39, see FIG. 9, may take between an erecting column 27 and the adjacent lift attaching member 21 projecting from the lifted slab 22 after the lifting fixture 37 has been removed. A U-bolt 43 is slipped over the column 27 and its threaded legs receive a clamping piece 44 that is secured by nuts 45 received on this threaded legs. The clamping piece 44 has welded thereto threaded studs 46 spaced the same distance apart as the projecting threaded legs of the lift attaching member 21. Turnbuckle members 47 secure the aligned threaded legs. The column 27 oppositely positioned has the same installation and by setting up of the respective turnbuckle members 47, the lifted slab 22 is set off and stabilizes the column 27 from slab 22 for a successive next lift of slab 23 thereabove all as more fully described hereinafter.

LIFTING

Figure 6:
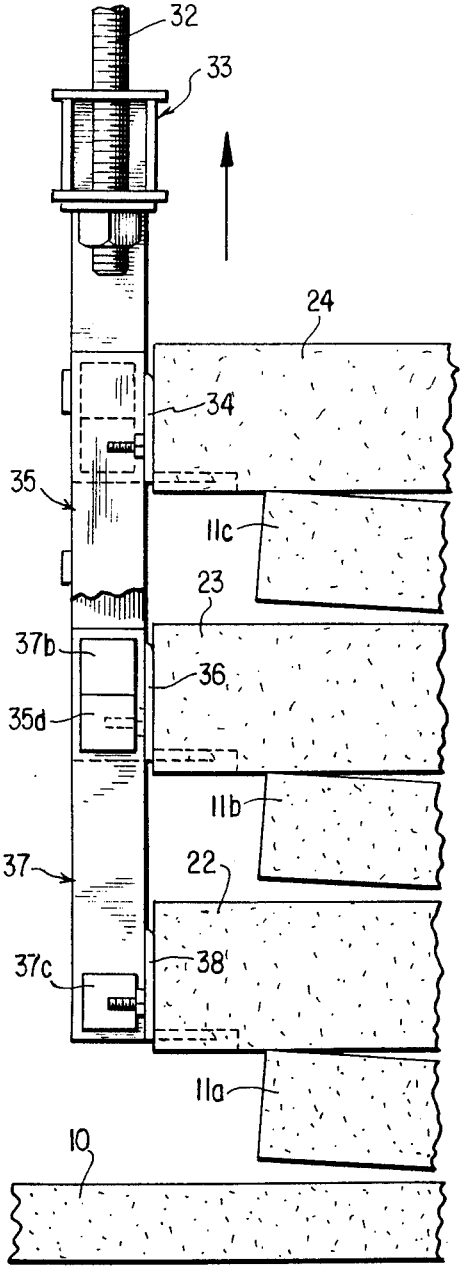
FIG. 6 is a view similar to FIG. 4 showing the initiation of the lift with the ceiling slabs and their supporting walls successively peeled-off and separated starting with the top most ceiling slab and its attached walls.
Figure 7:
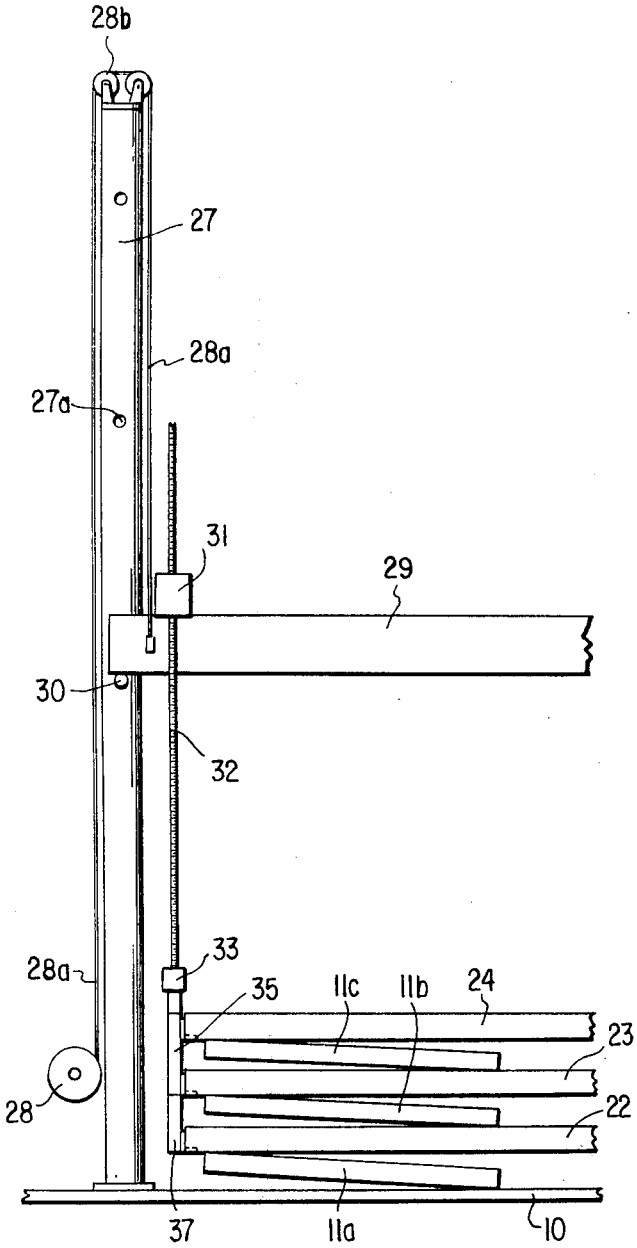
FIG. 7 is a side view of a vertical support column whose lower end is secured to a foundation support, one end of a bridge member hoisted into position by a hand winch and secured to the column, a lifting jack on the bridge and a lift rod attached to the lift fixtures, the slabs and walls having been peeled-off beginning with the roof slab and then separating each slab and its supporting wall in sequence.
Figure 10:
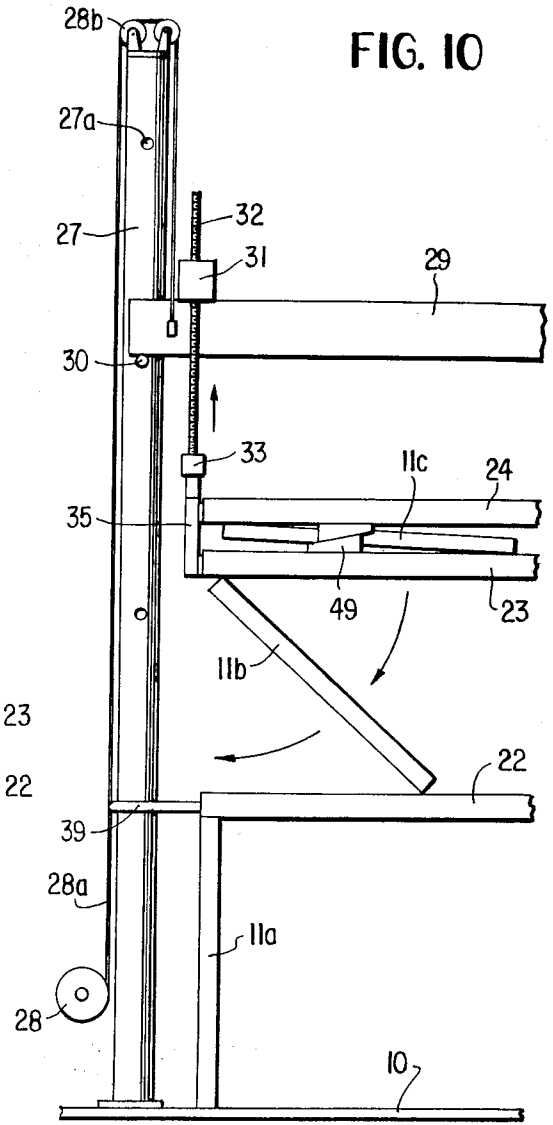
FIG. 10 is similar to FIG. 9 showing the bridge having been hoisted to its next upward position and secured to the column and the second floor supporting walls being swung outwardly into load bearing position as the lifting continues.

After the jacks 31 and their lifting rods 32 are installed and hooked up to control means such as a console, see for example U.S. Pat. No. 2,758,467, placed on the roof slab, the lifting can begin. The stack of slabs and their walls are peeled-out, i.e. the slabs and their walls are separated, see FIGS. 6 and 7. After the roof slab 24 is elevated say, for example with the lift fixtures described above, approximately one-half or three-fourths of an inch, the slack in the second lift fixture 35 is taken up an the second floor ceiling or roof slab 23 is lifted. Following this after lifting a fraction of an inch the second floor slab 22 is lifted, a sequence for lifting each fixture's load. Lifting then progresses at the normal rate and the first floor or story walls 11*a*, 12*a*, 13*a* and 14*a* swing slowly outward as their tops are elevated by lifing with their multiple pick-up cables 6. The bottom edges of the walls slide without damage across the ground floor slab 10 laterally, see FIG. 8, unassisted by rollers or other devices almost to their final vertical position. The walls offer considerable friction along their length thus imparting additional stability to the lift.

At the end of the first lift the walls are manually plumbed and lateraly aligned. Manual means or temporary pointed pins 48, see FIG. 8, are inserted in the apertures in the slab 22 aligned with the apertures 18 in the walls. This alignment is permitted because of the slack in the pick-up cables 16, see FIG. 14*b*. Before the stack is set down after the alignment of the walls the sealing material 41 as referred to above is installed.

The entire stack is now set down on the erected first story. As a technique for temporarily parking the stack and to allow the lifting equipment to be relocated, see FIG. 9, and to prevent the slabs and walls from closing again, wedges 49 are inserted from slab-to-slab substantially over the load bearing walls. Since these slabs overhang the erected load bearing walls, this weight of the stack above is directly transmitted through the load bearing walls to the ground floor slab 10.

The entire stack above is now supported by the completed first story load bearing walls and their ceiling slab, i.e., the second floor or story slab 22. The jacking means is disengaged by removing their continuously threaded lift rod attaching jack nuts if standard lift-slab jacking equipment is used. Using the winches 28, the bridges 29 and jacks 31 are lifted to the second station and the column support or shear pins 30 reinstalled at the next higher lift station. The lifting rods, attached to the top lift fixture 33, need no attention. The jacking nuts of the lift system are installed and their drive system is adjusted.

The lift fixtures designated by the reference number 37, their job done, are removed and set aside for reuse. The slab 22 now in place is stable. Installation of the stabilizers 39 shown in FIG. 16 fix the columns 27, see FIG. 9, ready for the next lift. By making the initial lift on very short effective length columns and by stabilizing the columns higher up as the building gains height, as referred to above, bracing, guying and deadmen are eliminated.

Figure 12:
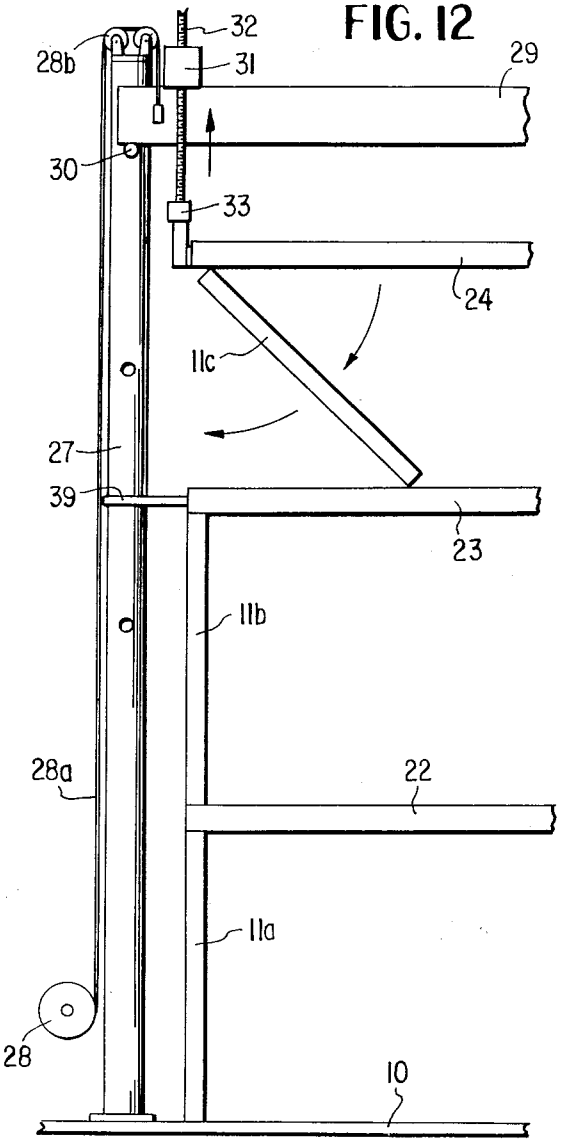
FIG. 12 is similar to FIG. 11 showing the bridge hoisted to its next lift position and secured to the column and the roof slab which is the third story ceiling slab being lifted with its load bearing walls being swung outwardly.
Figure 11:
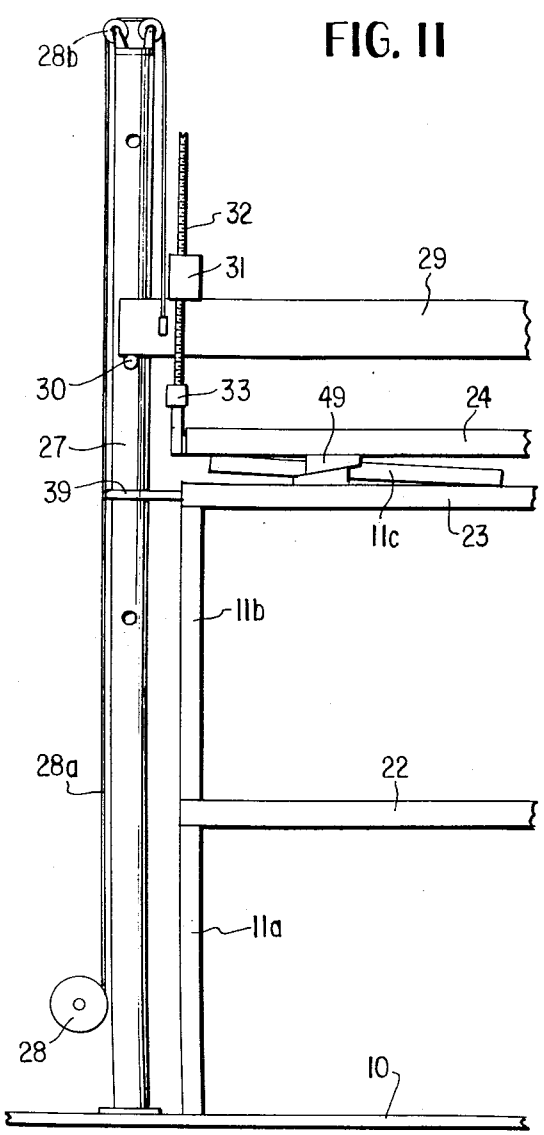
FIG. 11 is similar to FIG. 10 the second story walls are now in load bearing position supporting their ceiling slab whose lift fixture has been removed and a stabilizer member installed between the second story ceiling slab and the column.

The jacks 31 through their control console and connections (not shown) are actuated until the second slab 23 is in place, and the load bearing second story walls 11*b* are resting on the second floor slab or first floor ceiling slab 22. Again, see FIG. 11, the stack (roof slab 24 and third story walls 11*c*) are lowered onto the fixed third story floor slab 23 on wedges 49 already in place from the previous lift. The jacks are unloaded and disconnected. The lift fixtures 35 are removed and set aside for further usage and the columns stabilized as necessary. The bridge 29 and jacks 31 are hoisted into the final lift position and secured for stability. The roof slab 24 is lifted, see FIG. 12, as the attached third story walls 11*c* become substantially self-erecting.

Figure 13:
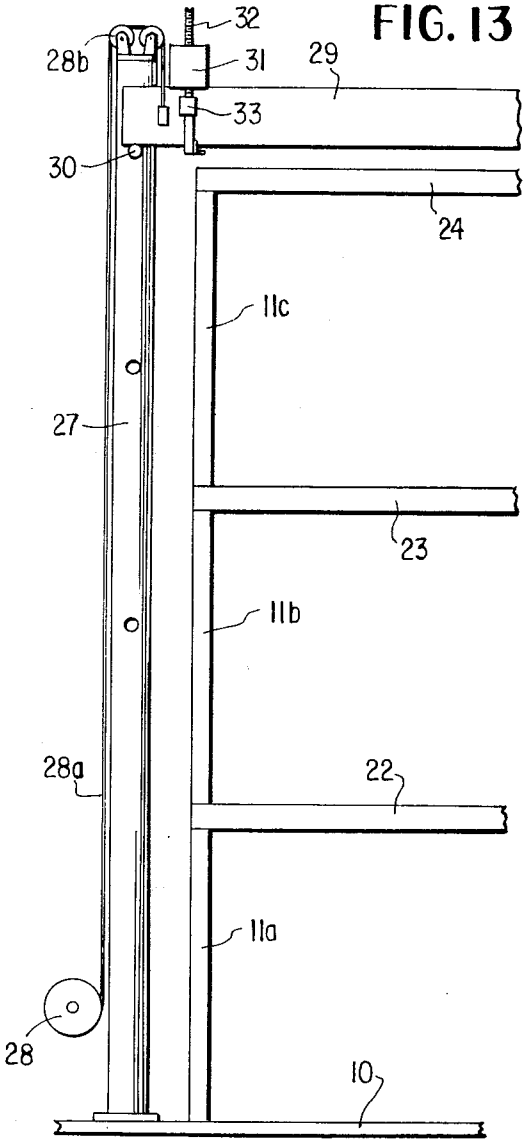
FIG. 13 is a view similar to FIG. 12 with the third story ceiling slab in position supported by its load bearing walls, the top lift fixture has been detached and the temporary stabilizers are removed and the lift apparatus is ready to be dismantled and moved to another site.

This completes this building unit, see FIG. 13. The casting and lifting sequence would merely be repeated for units having additional floors. The lifting equipment, columns, bridges, jacks, lifting rods, lift fixtures, wedges, stabilizing clamps, etc., are moved on to erect the next building unit.

The narrow voids in the walls are closed with the conventional precast panels such as shown in stacks 25 and 26 in FIG. 3 as referred to above. Steel reinforcing bars 42, see FIG. 15, are placed in the aligned vertical apertures or ducts 18 in the walls and vertical apertures in the floor slabs and grouted in to complete the vertical continuity and integrity of the structure. The building is finished in conventional manner.

What is claimed is:

1. Apparatus for erecting single or multiple story concrete columnless buildings, said apparatus comprising:

a permanent base for a building to be erected, said base providing a first casting bed;

a first set of load supporting, downwardly swingable wall panels positioned generally horizontally on said first casting bed;

filler material in any voids in or between said wall panels to provide a second casting bed;

a first floor slab positioned generally horizontally on said second casting bed and lying directly above said first set of wall panels;

lift attaching members secured to the periphery of said first floor slab;

a plurality of spaced apart, flexible pick-up cables connected along a pivot line between said wall panels and said floor slab to pivotally connect said wall panels to said floor slab thereby forming an interconnected first set of wall panels and corresponding floor slab;

additional sets of wall panels and floor slabs positioned one above the other in layers to provide a stack of said wall panels and floor slabs corresponding to the stories of the building, each layer utilizing the preceding layer as a casting bed;

lift attaching members secured to each of said additional floor slabs;

pairs of temporary spaced columns positioned exteriorly of said base and adjacent said lift attaching members, said columns being of slightly greater height than the height of the erected building;

a bridge member movably supported between each said pair of columns, each of said bridge members extending over said stack of wall panels and floor slabs and carrying lift means adjacent each column;

lift fixture assemblies attachable to, and extending between, said lift attaching members on said floor slabs and said lift means, and disconnectable from said lift attachings members of each floor once said floor has been erected;

means for actuating said lift means to raise said stack whereby each of the wall panels in said first set of wall panels will swing downwardly on said pick-up cables about said pivot lines to a vertical, load supporting position and further whereby said additional sets of wall panels and floor slabs are sequentially raised by said interconnected lift means, lift fixture assemblies and lift attaching members so that succeeding sets of wall panels swing into position to erect the additional stories of said building whereupon said temporary columns and said bridge members are dismantled and removed.

2. The apparatus of claim 1 further including stabilizing means connectable between each said column and each said floor slab once the floor slab has been positioned atop a corresponding set of downwardly swung panels whereby short effective working length columns are provided.

3. The apparatus of claim 1 further including aligned vertical apertures in each of said wall panels and corresponding apertures in said floor slabs whereby reinforcing bars may be inserted and grouted in said apertures once said building is erected.

4. The apparatus of claim 1 wherein each said pick-up cable comprises diverging double-stranded cables between said wall panels and said floor slabs, said strands converging at said pivot lines whereby the weight of each wall panel will be transferred from one to the other strand of each of its pick-up cables as the wall panels are swung toward the vertical, said cables permitting spauling of said panels along said pivot lines to compensate for slight pivot line misalignment or for slab deflection.

5. The apparatus of claim 1 further wherein each of said lift fixture assemblies comprises, in combination, a first lift fixture having a crosshead for attachment of lift rods connectable to said lift means on said bridge members, a first tension bar depending from said crosshead, means adjacent a lower end of said first tension bar for attaching said first lift fixture to said lift attaching member of an uppermost floor slab, and means on said tension bar for attachment of a second lift fixture; said second lift fixture having a second tension bar, means on said second tension bar for engagement with said first lift fixture, means adjacent a lower end of said second tension bar for attaching said second lift fixture to said lift attaching member of a second floor slab and means on said second tension bar for attachment of subsequent lift attaching fixtures whereby a number of lift fixtures corresponding to the number of said floor slabs are interconnectable to each other and to said floor slabs to provide each said lift fixture assembly.

* * * * *